US006450152B1

(12) United States Patent
Everingham

(10) Patent No.: US 6,450,152 B1
(45) Date of Patent: Sep. 17, 2002

(54) LOW-PROFILE FUEL TANK ISOLATION VALVE

(75) Inventor: Gary M. Everingham, Chatham (CA)

(73) Assignee: Siemens Automotive Inc., Chatham (CA)

( * ) Notice: Subject to any disclaimer, the term of this patent is extended or adjusted under 35 U.S.C. 154(b) by 0 days.

(21) Appl. No.: 09/882,078

(22) Filed: Jun. 15, 2001

(51) Int. Cl.[7] ..... F02M 37/04
(52) U.S. Cl. ..... 123/516; 123/518; 251/129.21
(58) Field of Search ..... 251/129.21; 123/516, 123/518, 519, 520

(56) References Cited

U.S. PATENT DOCUMENTS 4,986,246 A * 1/1991 Kessler de Vivie et al. 123/519
5,809,977 A * 9/1998 Krimmer ..... 123/516
6,149,126 A * 11/2000 Krimmer ..... 251/129.21

* cited by examiner

*Primary Examiner*—Thomas N. Moulis

(57) ABSTRACT

A low-profile tank isolation valve mounts on a wall of a fuel tank to enclose an opening in the tank wall through which an inlet port of the valve is communicated to tank headspace. An electric actuator is selectively energized to selectively operate an armature to cause a closure to seat on, and unseat from, a valve seat. The armature is a cylindrical walled tube that is disposed within a central through-hole of the actuator and is selectively positioned along a straight axis coincident with the tube axis. An element that operatively relates the armature to the closure constrains vapor flow through the valve to pass through the armature tube when the closure is unseated. The seat, closure, and element are all disposed within the actuator through-hole.

28 Claims, 2 Drawing Sheets

LOW-PROFILE FUEL TANK ISOLATION VALVE

FIELD OF THE INVENTION

This invention relates generally to a fuel vapor management system for a motor vehicle that is powered by an internal combustion engine and more particularly to a valve for isolating headspace of a fuel tank from a vapor storage canister.

BACKGROUND OF THE INVENTION

A known on-board fuel vapor management system for an automotive vehicle comprises a vapor storage canister that collects volatile fuel vapors generated in headspace of a fuel tank by the volatilization of liquid fuel in the tank and a purge valve for periodically purging collected vapors from the canister to an intake system of the engine. A known type of purge valve, sometimes called a canister purge solenoid (or CPS) valve, comprises a solenoid actuator that is under the control of a microprocessor-based engine management system.

During conditions conducive to purging, the canister is purged of collected fuel vapors by communicating the canister to the engine intake system through the CPS valve. The CPS valve is opened by a signal from an engine management computer in an amount that allows intake manifold vacuum to draw volatile fuel vapors from the canister for entrainment with the combustible mixture passing into the engine's combustion chamber space at a rate consistent with engine operation to provide both acceptable vehicle driveability and an acceptable level of exhaust emissions.

It is desirable to vent the canister to atmosphere to allow stored vapors to be more efficiently purged to the engine. It is known to communicate a vent port of a canister through a vent valve to atmosphere. The vent valve may be opened during certain conditions, such as during purging of the canister, and closed during other conditions, such as during a leak detection test.

In certain vapor management systems, the fuel tank headspace is in continuous communication with the canister. Other systems may call for the canister to be isolated from the tank headspace during certain conditions, in which case, the system may further comprise a tank isolation valve that, when open, allows free communication between the tank headspace so that vapors can pass from the tank to the canister, and that, when closed, disallows free communication to isolate the tank headspace from the canister.

It is known to mount such an isolation valve in a generally vertical orientation and at a location in a vehicle that is remote from the fuel tank.

SUMMARY OF THE INVENTION

It is believed that a tank isolation valve that can be mounted directly on a fuel tank and in a generally vertical orientation can provide certain benefits in the design of an automotive vehicle fuel system and associated vapor management system, especially if the valve is more vertically compact, and/or is capable of being partially disposed within the interior of a fuel tank. An isolation valve that is more vertically compact and/or capable of being partially disposed within a depression in a tank wall can present a lower external profile when the tank and valve are viewed in vertical elevation. It is believed that such a lower profile can be useful to vehicle designers in packaging various components of the vehicle in and adjacent the fuel tank.

Principles of the invention, as disclosed herein, provide a low-profile tank isolation valve possessing these attributes and capabilities.

In one general respect, the present invention relates to a fuel vapor management system for an internal combustion engine fuel system wherein fuel vapor generated by the volatization of fuel in a fuel tank is collected in a vapor storage canister that is purged to the engine during conditions conducive to purging. Headspace of the fuel tank is selectively communicated to the vapor storage canister through a tank isolation valve. When open, the valve allows free communication between the tank headspace and the canister so that volatile vapor can pass from the tank to the canister, and when closed, the valve disallows free communication to thereby isolate the tank headspace from the canister.

The valve comprises a body mounted on a wall of the tank in enclosing relation to an opening in the tank wall. The valve has an inlet port communicated to the tank headspace at the tank wall opening, an outlet port, and a flow passage through which vapor entering the inlet port from the headspace can be conveyed to the outlet port. A valve seat circumscribes the flow passage, and a closure selectively seats on, and unseats from, the valve seat to selectively close, and open, the flow passage. An operating mechanism comprises an electric actuator that is selectively energized by electric current and an armature that is selectively positioned by the selective energization of the actuator to selectively operate the closure to seat on, and unseat from, the valve seat. An element that is disposed between the armature and the closure operatively relates the armature to the closure. The armature comprises a cylindrical walled tube that is open at opposite axial ends and is selectively positioned within the body along a straight axis coincident with the tube axis. The element constrains vapor flowing through the flow passage to pass through the armature tube when the closure is unseated from the seat.

In another respect, the present invention relates to a valve, as just described, for venting tank headspace.

In another general respect, the present invention relates to a fuel vapor management system as defined above wherein the tank isolation valve comprises an inlet port communicated to the tank headspace at the tank wall opening, an outlet port, and a flow passage through which vapor entering the inlet port from the headspace can be conveyed to the outlet port. A valve seat circumscribes the flow passage, and a closure selectively seats on, and unseats from, the valve seat to selectively close, and open, the flow passage. An operating mechanism comprises an electromagnet coil that is selectively energized by electric current to selectively position an armature coaxially with respect to a central through-hole of the coil to cause the closure to seat on, and unseat from, the valve seat. The seat and the closure are disposed within the coil through-hole, and the armature comprises a through-passage having opposite ends, one of which is disposed within the through-hole and is toward the closure and the other of which is toward one of the ports, to provide for vapor that passes from the inlet port to the outlet port when the closure is unseated from seat to pass through the through-passage in the armature.

In another respect, the present invention relates to a valve, as described in the immediately preceding paragraph, for venting tank headspace.

Additional aspects of the invention relate to various constructional details of the valve.

The foregoing, along with additional features, advantages, and benefits of the invention, will be seen in the ensuing description and claims which should be considered in conjunction with the accompanying drawings. The drawings disclose a presently preferred embodiment of the invention according to the best mode contemplated at this time for carrying out the invention.

DESCRIPTION OF THE PREFERRED EMBODIMENT

Figure 1:
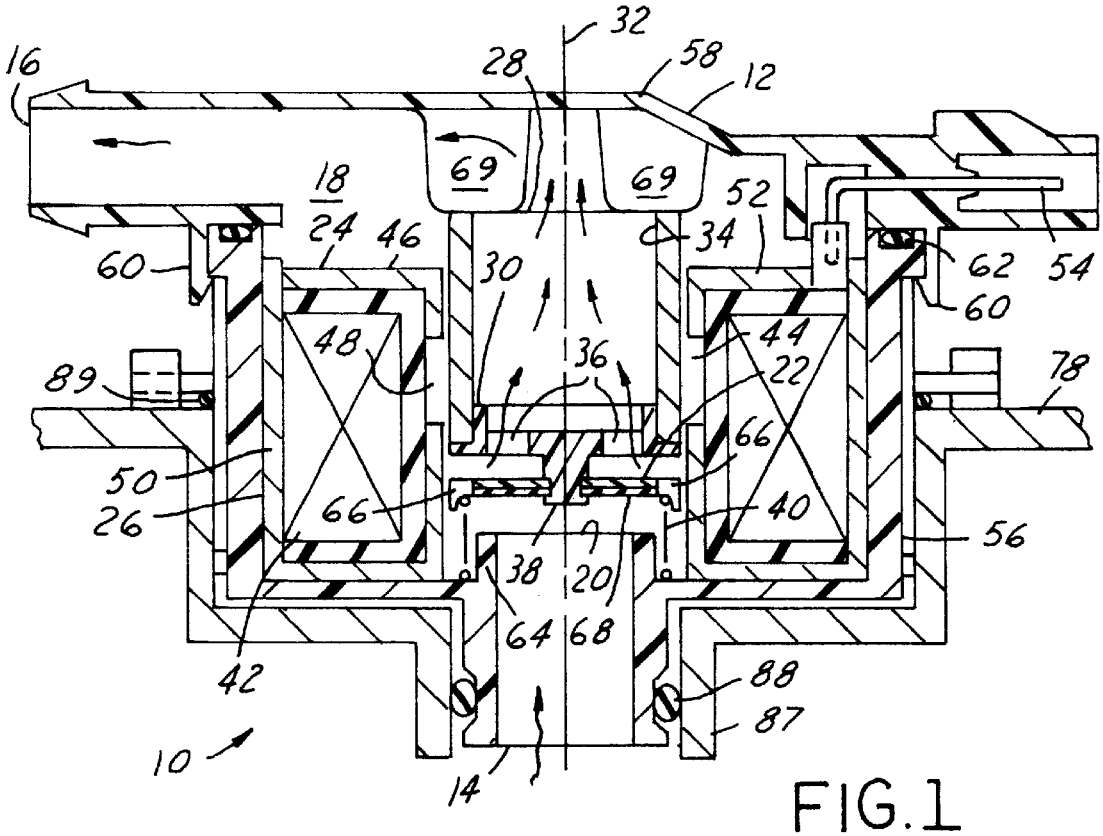
FIG. 1 a longitudinal cross-sectional view, in elevation, through a valve embodying principles of the invention, and includes a portion of a fuel tank on which the valve is mounted.

FIG. 1 shows an exemplary embodiment of tank isolation valve 10 according to the present invention for selectively communicating headspace of a motor vehicle fuel tank to a vapor storage canister. Valve 10 comprises a body 12 having an inlet port 14 adapted to be communicated to the tank headspace, an outlet port 16, and a flow passage 18 extending between the two ports.

A valve seat 20 circumscribes passage 18 interiorly of, and proximate, inlet port 14. A closure 22 is disposed for selectively seating on, and unseating from, seat 20 to selectively close, and open, passage 18. FIG. 1 shows valve 10 open with closure 22 unseated from seat 20.

An operating mechanism 24 for operating closure 22 comprises an electric actuator 26 that is selectively energized by electric current. An armature 28 is selectively positioned by the selective energization of actuator 26 to selectively operate closure 22 to seat on, and unseat from, seat 20. An element 30 is disposed between armature 28 and closure 22 to operatively relate the armature to the closure.

Armature 28 comprises a circular cylindrical walled ferromagnetic tube that is open at opposite axial ends and is selectively positioned by operating mechanism 24 within body 12 along a straight axis 32 coincident with the tube axis. One axial end of the tube is toward outlet port 16 while the other axial end is toward closure 22. The tube wall circumscribes a circular cylindrical through-passage 34 that extends between axial ends of the tube.

Element 30 is preferably fit to the one axial end of the armature tube that is toward closure 22 in covering relation to through-passage 34, but comprises at least one through-opening 36 that is open to the through-passage. With closure 22 unseated from seat 20, element 30 constrains flow that has entered inlet port 14 and has passed the unseated closure to pass through through-passage 34 before reaching outlet port 16 and exiting valve 10. Element 30 comprises a cylindrical body having a shouldered perimeter rim seating the element on the one axial end of the armature tube, and a post 38 that extends from a central region of the body of the element toward closure 22 for operatively relating the element to the closure.

Closure 22 comprises a cylindrical body having a central region joining with a distal end of post 38 to join element 30 and closure 22 for motion in unison. The central region of the closure body and the distal end of post 38 join together at a joint that allows closure 22 to tilt slightly on post 38 for compliant seating on valve seat 20.

Operating mechanism 24 further comprises a spring 40 that resiliently biases element 30 and closure 22 away from inlet port 14 and hence away from seating on seat 20.

Actuator 26 comprises an electromagnet coil 42 disposed about a central through-hole 44 that is concentric with axis 32 and hence with the armature tube. A stator 46 is associated with coil 42 to form a solenoid assembly with the stator conducting magnetic flux across an air gap 48 to act on armature 28. Stator 46 comprises two ferromagnetic parts, namely a cup 50 and a cap 52, that cooperate to enclose coil 42, except where electric terminals 54 pass through cap 52 to provide for coil 42 to be connected to an external electric circuit (not shown) for operating the coil.

Body 12 comprises two individual parts 56, 58 assembled together. Part 56 comprises a plastic shell having a circular cylindrical shape. Part 58 comprises a circular plastic cover that carries terminals 54. The two parts fit together at a sealed joint to capture and enclose the solenoid assembly and to associate terminals 54 with coil 42. Catches 60 on one of the parts catch an overhang on the other of the parts at the joint to secure the parts to each other, and sealing is provided by an O-ring 62 disposed in a circular groove in one of the two parts. Inlet port 14 and valve seat 20 are formed integrally with part 56. Inlet port 14 comprises an integral tubular nipple of part 56 extending outward of the interior of body 12 from a bottom end wall of part 56 with its centerline concentric with axis 32. Interiorly of body 12, a circular cylindrical riser 64 continues as an inward extension of inlet port 14. Riser 64 extends into through-hole 44 with its end edge surface forming seat 20. In this way seat 20 is disposed within through-hole 44. Element 30 and closure 22 are also disposed within through-hole 44. Outlet port 16 is formed integrally with part 58 as a tubular nipple that extends radially outward beyond the joint between the two parts 56, 58. A connector shell for terminals 54 is also integrally formed with part 58.

Spring 40 comprises a helical coil one end of which seats on the portion of the bottom end wall of part 56 that surrounds riser 64 and the opposite end of which seats against the outer margin of closure 22. While the portion of closure 22 bounded by its outer margin is imperforate, the portion that comprises the outer margin contains circumferentially spaced apart notches 66. In this way the imperforate portion of the closure will obturate passage 18 when the closure is seated on seat 20, but once the closure has unseated, vapor can pass from inlet port 14 across seat 20 and through notches 66 on its way to outlet port 16. To assure vapor-tight seating of the closure on seat 20, it may be desirable to apply a circular seal 68 of any suitable material to the portion of closure 22 that seats on seat 20.

FIG. 1 shows valve 10 in a condition where coil 42 is not being energized. Spring 40 is biasing the assembly consisting of closure 22, element 34, and armature 28 away from inlet port 14 to cause the end of armature 28 opposite element 34 to abut a stop 68. Stop 68 comprises several posts that extend downward into the interior of body 12 from a wall of cover 58 directly above armature 28. The posts are spaced apart from each other to provide free communication of through-passage 34 to outlet port 16 when armature 28 is abutting stop 68.

Figure 2:
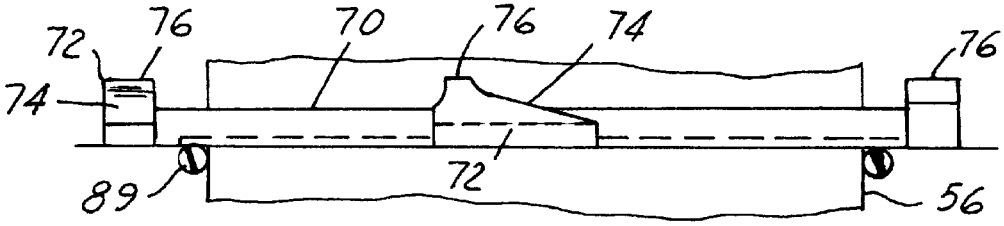
FIG. 2 is an elevation view, not in cross section, of a fragmentary portion of the valve relevant to its mounting on the fuel tank.

Part 56 comprises features on the exterior of its side wall that provide for secure mounting on a wall of a fuel tank. Those features are shown in the fragmentary view of FIG. 2. A circular flange 70 girdles the side wall and supports four identical upright locking elements 72 spaced uniformly around, and a short distance from, the side wall. Each locking element comprises an upper edge that begins with an inclined ramp 74 and ends in a locking barb 76. The locking elements are adapted for cooperation with features on a fuel tank to provide a twist lock mounting of valve 10 on the tank.

Figure 3:
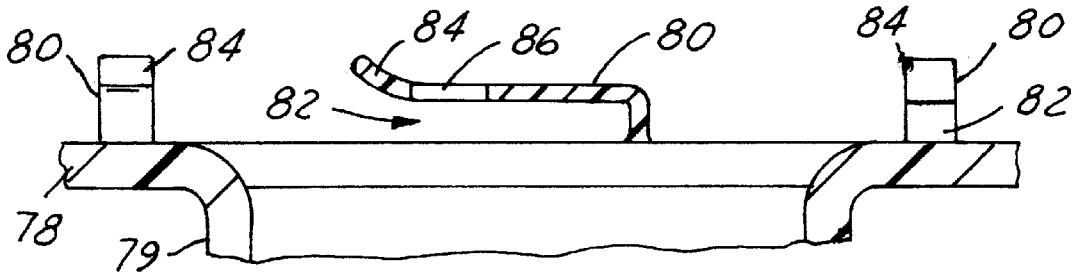
FIG. 3 is view of FIG. 1 with the valve removed to show detail of locking features on the tank relevant to the valve mounting.
Figure 4:
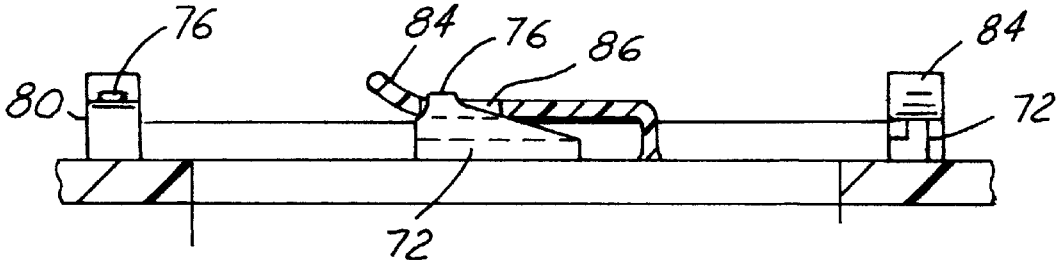
FIG. 4 is fragmentary view, partly in cross section, showing the valve locked on the tank by the tank locking features.

FIG. 3 shows a portion of a top horizontal wall 78 of a fuel tank. Four identical catches 80 having open throats 82 are spaced uniformly on the exterior of wall 78 around the rim of a depressed receptacle 79 in wall 78. The bottom of the receptacle has an circular hole that allows inlet port 14 to be disposed in the tank headspace for placing the inlet port in communication with the tank headspace. Valve 10 mounts on the tank by aligning it to the receptacle with locking elements 72 out of circumferential registration with catches 80, and then advancing it toward the tank until flange 70 abuts the receptacle rim at wall 78. The valve is then turned to cause each locking element 72 to enter the open throat 82 of a respective catch 80. As ramps 74 ride across leads 84 at the free ends of the catches, the catches flex. When barbs 76 arrive at holes 86 in the catches immediately proximal to leads 84, the catches relax, causing the barbs to lodge to the holes and thereby lock the valve in the receptacle as shown by FIG. 4.

The mounted valve is suitably sealed to the tank wall to prevent leakage between the valve body and the receptacle hole. Receptacle 79 may be shaped with a shoulder that forms a neck 87 to which an O-ring 88 on inlet port 14 can seal. A gasket 89 may be provided between flange 70 and the rim of the receptacle.

Figure 5:
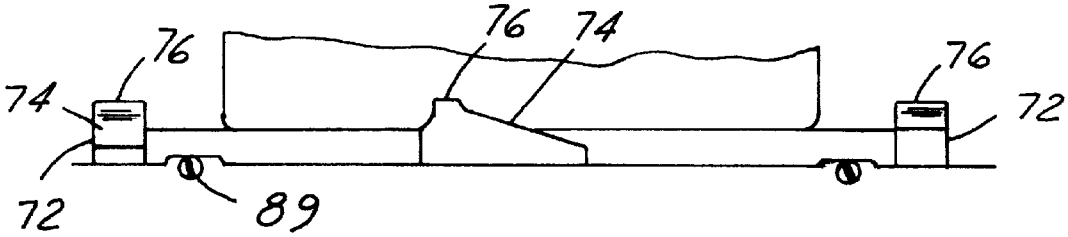
FIG. 5 is view like FIG. 2 showing a modified mounting.

FIG. 1 shows flange 70 disposed approximately at mid-height of valve body 12 so that when the valve is mounted in the depressed receptacle, only an upper portion of the valve protrudes from the receptacle. FIG. 5 shows an alternate arrangement where flange 70 is close to the bottom of the valve body so that the overall profile will be higher. An appropriate change is made to the shape of the tank receptacle for the valve. Flange 70 may optionally have holes to provide for mounting by means of fasteners, rather than use of the twist-lock feature. Such a fastener alternative provides one way for allowing valve 10 to be mounted remote from the tank, in which case inlet port 14 may be communicated to the tank headspace via a hose, or conduit. Another conduit is also present to communicate outlet port 16 to the canister in all embodiments.

Figure 6:
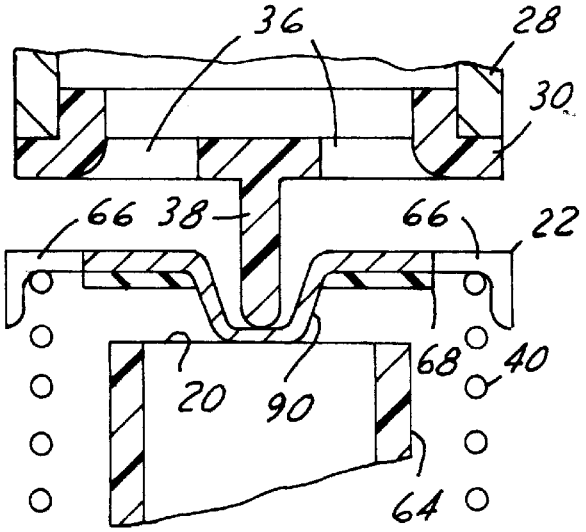
FIG. 6 is a fragmentary view illustrating a modified internal mechanism of the valve.

FIG. 6 shows a modified form for closure 22 and element 30. Rather than directly attaching closure 22 to the distal end of post 38, closure 22 has a depression 90 at its center, and post 38 has a rounded end that fits into the depression. This enables closure 22 to tilt on the post and provide for compliance of closure 22 to seat 20.

Figure 7:
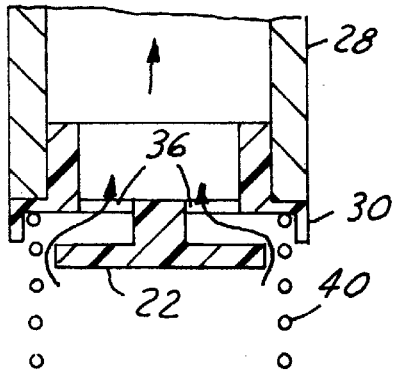
FIG. 7 is a fragmentary view illustrating another modified internal mechanism of the valve.

FIG. 7 shows another modified form for closure 22 and element 30. Here the closure and element are formed as a single part, and the notched outer rim of closure 22 is eliminated so that spring 40 fits over it to seat on the outer rim of element 30. Because closure 22 and element 30 are a single part that is relatively rigid, it may be desirable to apply a circular seal 68 suitable material to the portion of closure 22 that seats on seat 20 to secure compliant seating.

The valve of the present invention possesses a low vertical profile because seat 20, closure 22, element 30 and most of armature 28 are disposed within the central through-hole 44 in the armature. The overall profile of valve and tank is lowered even more by providing a depressed receptacle in the top wall of the tank as described. Use of a cylindrical tube for the armature and venting through the tube provides a substantial transverse cross section for the flow area in relation to the diameter of the through-hole in the actuator. Although not specifically shown, the armature is guided in any suitable manner that avoids shorting of the air gap by the armature.

While a presently preferred embodiment of the invention has been illustrated and described, it should be appreciated that principles are applicable to other embodiments that fall within the scope of the following claims.

What is claimed is:

1. A fuel vapor management system for an internal combustion engine fuel system wherein fuel vapor generated by the volatization of fuel in a fuel tank is collected in a vapor storage canister that is purged to the engine during conditions conducive to purging, and headspace of the fuel tank is selectively communicated to the vapor storage canister through a tank isolation valve that comprises a valve body and that when open, allows free communication between the tank headspace and the canister so that volatile vapor can pass from the tank to the canister, and when closed, disallows free communication to thereby isolate the tank headspace from the canister, the system comprising:

an opening in a wall of the tank on which the body of the valve is mounted in enclosing relation to the opening;

the valve further comprising an inlet port communicated to the tank headspace at the opening, an outlet port, and a flow passage through which vapor entering the inlet port from the headspace can be conveyed to the outlet port;

a valve seat circumscribing the flow passage;

a closure for selectively seating on, and unseating from, the valve seat to selectively close, and open, the flow passage;

an operating mechanism comprising an electric actuator that is selectively energized by electric current and an armature that is selectively positioned by the selective energization of the actuator to selectively operate the closure to seat on, and unseat from, the valve seat;

an element that is disposed between the armature and the closure to operatively relate the armature to the closure;

wherein the armature comprises a cylindrical walled tube that is open at opposite axial ends and is selectively positioned within the body along a straight axis coincident with the tube axis, and the element constrains vapor flowing through the flow passage to pass through the armature tube when the closure is unseated from the seat.

2. A system as set forth in claim 1 in which the element is fit to the tube at the one axial end of the tube and comprises at least one through-opening through which vapor can pass into the tube.

3. A system as set forth in claim 2 wherein the element comprises a cylindrical body having a shouldered perimeter rim seating the element on the one axial end of the tube, and a post that extends from a central region of the body of the element toward the closure for operatively relating the element to the closure.

4. A system as set forth in claim 3 wherein the closure comprises a cylindrical body having a central region joining with a distal end of the post to join the element and the closure for motion in unison, and the central region of the closure body and the distal end of the post join together at a joint that allows the closure to tilt slightly on the post for compliant seating on the valve seat.

5. A system as set forth in claim 3 wherein the operating mechanism comprises a spring that resiliently biases the element and the closure away from seating on the valve seat, the valve seat is disposed proximate the inlet port and, the spring acts to bias the element and the closure away from the inlet port.

6. A system as set forth in claim 3 wherein the operating mechanism comprises a spring, and the closure comprises a cylindrical body that is resiliently biased by the spring away from seating on the valve seat and that has a central region biased against a distal end of the post so as to allow the closure to tilt slightly relative to the post for compliant seating on the valve seat.

7. A system as set forth in claim 6 wherein the actuator comprises an electromagnet coil disposed about a central through-hole with respect to which the armature tube is selectively coaxially positioned, the valve seat is disposed within the through-hole, and when the closure is seated on the seat, the element and the closure are also disposed within the through-hole.

8. A system as set forth in claim 1 wherein the top wall of the tank comprises a depressed receptacle containing the opening, and the valve body fits into the receptacle so that only an upper portion of the valve body protrudes out of the receptacle.

9. A fuel vapor management system for an internal combustion engine fuel system wherein fuel vapor generated by the volatization of fuel in a fuel tank is collected in a vapor storage canister that is purged to the engine during conditions conducive to purging, and headspace of the fuel tank is selectively communicated to the vapor storage canister through a tank isolation valve that comprises a valve body and that when open, allows free communication between the tank headspace and the canister so that volatile vapor can pass from the tank to the canister, and when closed, disallows free communication to thereby isolate the tank headspace from the canister, the system comprising:

an opening in a wall of the tank on which the body of the valve is mounted in enclosing relation to the opening;

the valve further comprising an inlet port communicated to the tank headspace at the opening, an outlet port, and a flow passage through which vapor entering the inlet port from the headspace can be conveyed to the outlet port;

a valve seat circumscribing the flow passage;

a closure for selectively seating on, and unseating from, the valve seat to selectively close, and open, the flow passage;

an operating mechanism comprising an electromagnet coil that is disposed about a central through-hole and is selectively energized by electric current to selectively position an armature coaxially with respect to the central through-hole to cause the closure to seat on, and unseat from, the valve seat;

wherein the seat and the closure are disposed within the central through-hole, and the armature comprises a through-passage having opposite ends, one of which is disposed within the through-hole and is toward the closure and the other of which is toward one of the ports, to provide for gases that pass from the inlet port to the outlet port when the closure is unseated from the seat to pass through the armature through-passage.

10. A system as set forth in claim 9 including an element that is fit to the armature at the one end thereof and comprises at least one through-opening through which vapor enters the through-passage after having passed the unseated closure.

11. A system as set forth in claim 9 wherein the seat is disposed at a distal end of a riser that is disposed on a wall of the valve body in circumscribing relation to the flow passage.

12. A system as set forth in claim 11 wherein the seat comprises a surface of the riser.

13. A system as set forth in claim 8 wherein the top wall of the tank comprises a depressed receptacle containing the opening, and the valve body fits into the receptacle so that only an upper portion of the valve body protrudes out of the receptacle.

14. A valve for selectively venting headspace of a fuel tank in an automotive vehicle having an engine that is powered by volatile fuel stored in the tank, the valve comprising:

a body having an inlet port adapted to be communicated to the tank headspace, an outlet port, and a vent passage between the ports;

a valve seat circumscribing the passage;

a closure for selectively seating on, and unseating from, the seat to selectively close, and open, the passage;

an operating mechanism comprising an electric actuator that is selectively energized by electric current and an armature that is selectively positioned by the selective energization of the actuator to selectively operate the closure to seat on, and unseat from, the seat;

wherein the armature comprises a through-passage having opposite ends, one of which is toward the closure and the other of which is toward one of the ports; and an element that is disposed between the armature and the closure to operatively relate the armature to the closure and that, when the closure is unseated from the seat, constrains flow between the ports to pass through the through-passage in the armature.

15. A valve as set forth in claim 14 wherein the armature comprises a cylindrical walled tube that is open at opposite axial ends and is selectively positioned within the body along a straight axis coincident with the tube axis, one axial end of the tube being toward the one port and the other axial end being toward the closure, and the through-passage extends between the axial ends of the tube and is circumscribed by the wall of the tube.

16. A valve as set forth in claim 15 in which the element is fit to the tube at the one axial end of the through-passage and comprises at least one through-opening that is open to the through-passage.

17. A valve as set forth in claim 16 wherein the element comprises a cylindrical body having a shouldered perimeter rim seating the element on the one axial end of the tube, and a post that extends from a central region of the body of the element toward the closure for operatively relating the element to the closure.

18. A valve as set forth in claim 17 wherein the closure comprises a cylindrical body having a central region joining with a distal end of the post to join the element and the closure for motion in unison.

19. A valve as set forth in claim 18 wherein the central region of the closure body and the distal end of the post join together at a joint that allows the closure to tilt slightly on the post for compliant seating on the valve seat.

20. A valve as set forth in claim 17 wherein the operating mechanism comprises a spring that resiliently biases the element and the closure away from seating on the valve seat.

21. A valve as set forth in claim 20 wherein the valve seat is disposed proximate the inlet port and the spring acts to bias the element and the closure away from the inlet port.

22. A valve as set forth in claim 17 wherein the operating mechanism comprises a spring, and the closure comprises a cylindrical body that is resiliently biased by the spring away from seating on the valve seat and that has a central region biased against a distal end of the post so as to allow the closure to tilt slightly relative to the post for compliant seating on the valve seat.

23. A valve as set forth in claim 16 wherein the armature tube is selectively positioned coaxially with respect to a central through-hole of the electric actuator, and the valve seat is disposed within the actuator through-hole.

24. A valve as set forth in claim 22 wherein the element and the closure are disposed within the actuator through-hole when the closure is seated on the seat.

25. A valve for selectively venting headspace of a fuel tank in an automotive vehicle having an engine that is powered by volatile fuel stored in the tank, the valve comprising:

a body having an inlet port adapted to be communicated to the tank headspace, an outlet port, and a vent passage between the ports;

a valve seat circumscribing the passage;

a closure for selectively seating on, and unseating from, the seat to selectively close, and open, the passage;

an operating mechanism comprising an electric actuator comprising an electromagnet coil that is disposed about a central through-hole and is selectively energized by electric current to selectively position an armature with respect to the central through-hole to cause the closure to seat on, and unseat from, the seat;

wherein the seat and the closure are disposed within the central through-hole, and the armature comprises a through-passage having opposite ends, one of which is disposed within the through-hole and is toward the closure and the other of which is toward one of the ports, to provide for flow through the passage to pass through the through-passage in the armature when the closure is unseated from seat.

26. A vent valve as set forth in claim 25 including an element that is fit to the armature at the one end thereof and comprises at least one through-opening through which flow enters the through-passage after having passed the unseated closure.

27. A vent valve as set forth in claim 25 wherein the seat is disposed at a distal end of a riser that is disposed on a wall of the valve body in circumscribing relation to the vent passage.

28. A vent valve as set forth in claim 27 wherein the seat comprises a surface of the riser.

* * * * *